US006227843B1

(12) United States Patent
Pedersen et al.

(10) Patent No.: US 6,227,843 B1
(45) Date of Patent: May 8, 2001

(54) PORTABLE GAS CAMPFIRE

(76) Inventors: Robert V. Pedersen, 3705 Glenrosa Road, Westbank, British Columbia (CA), V4T 1V9; Jeffrey A. Schlechtleitner, 600 Sumac Road East, Kelowna, British Columbia (CA), V1X 4V1

( * ) Notice: Subject to any disclaimer, the term of this patent is extended or adjusted under 35 U.S.C. 154(b) by 0 days.

(21) Appl. No.: 09/546,386

(22) Filed: Apr. 10, 2000

Related U.S. Application Data

(60) Provisional application No. 60/137,610, filed on Jun. 3, 1999.

(51) Int. Cl.[7] ..... F24C 3/04

(52) U.S. Cl. ..... 431/125; 126/512; 126/92 AC; 126/41 R

(58) Field of Search ..... 126/512, 39 E, 126/39 R, 25 B, 92 AC, 41 R, 519; 431/175, 125, 170, 354, 285, 287

(56) References Cited

U.S. PATENT DOCUMENTS

| | | | | |
|---|---|---|---|---|
| D. 346,530 | | 5/1994 | Elliott et al. | D7/416 |
| 3,410,261 | | 11/1968 | Cooper et al. | 126/25 |
| 3,582,250 | | 6/1971 | Chatfield | 431/125 |
| 3,589,312 | | 6/1971 | Cooper | 110/1 F |
| 3,605,653 | | 9/1971 | Donnell | 110/1 F |
| 3,987,779 | * | 10/1976 | Richardson | 126/512 |
| 4,110,063 | * | 8/1978 | Mitchell | 431/125 |
| 4,779,608 | | 10/1988 | Smith | 126/127 |
| 4,891,005 | | 1/1990 | Carter | 431/343 |
| 4,922,887 | | 5/1990 | Foxford | 126/41 |
| 5,081,981 | * | 1/1992 | Beal | 126/92 R |
| 5,094,223 | | 3/1992 | Gonzalez | 126/25 |
| 5,598,834 | | 2/1997 | Grady | 126/506 |
| 5,655,435 | * | 8/1997 | Rachesky et al. | 126/9 R |
| 5,868,128 | | 2/1999 | Omar | 129/512 |
| 5,901,697 | * | 5/1999 | Oliver, Jr. et al. | 126/512 |
| 6,044,836 | * | 4/2000 | Oliver, Jr. et al. | 126/512 |

FOREIGN PATENT DOCUMENTS

| | | | | |
|---|---|---|---|---|
| 2232593 | | 2/1999 | (CA) | C10L/5/14 |
| 797864 | * | 5/1936 | (FR) | 126/39 R |
| 505690 | * | 5/1939 | (GB) | 126/39 |
| 2075175 | | 11/1981 | (GB) | F23D/1/00 |
| 2 228 791 | * | 5/1990 | (GB) | 126/512 |
| 58-179717 | * | 10/1983 | (JP) . | |

* cited by examiner

*Primary Examiner*—Carl D. Price
(74) *Attorney, Agent, or Firm*—Antony C. Edwards

(57) ABSTRACT

A gas-fired portable campfire includes a base container, a gas burner tube mounted into the base container, and non-flammable low-density particulate insulating filler mountable into the base container so as to cover the gas burner. The gas burner tube has an inlet aperture for mounting to a gas supply and a spaced apart array of outlet apertures arranged so as to be radially spaced generally around a center of the container. The outlet apertures are radially inwardly inclined so as to direct gas jets from the outlet apertures upwardly and inwardly toward the center so as to form a generally conically shaped flame pattern when the gas jets are ignited.

5 Claims, 3 Drawing Sheets

PORTABLE GAS CAMPFIRE

CROSS REFERENCE TO RELATED APPLICATION

This application claims priority from United States Provisional Patent Application No. 60/137,610 filed Jun. 3, 1999 titled Portable Propane Campfire.

FIELD OF THE INVENTION

This invention relates to the field of portable campfires. More particularly this invention relates to portable campfires of the type which utilize propane, natural gas, or the like as a source of fuel and which have a burner designed to direct the flames therefrom in a generally inwardly and upwardly direction relative to the sides of the campfire, through ceramic logs, so as to have a generally conical appearance to thereby replicate the appearance of the traditional wood campfire.

BACKGROUND OF THE INVENTION

The authentic wood burning campfire is an integral part of the outdoor camping experience of campers requiring a wood campfire as a heat source for meal preparation is dwindling and the campfire is becoming solely a source of pleasure for ones atavistic nature.

There are, however, many concerns associated with open fires and campfires in particular which this invention seeks to overcome. Open fires in areas used for camping and recreation pursuits can be dangerous and require experience and skill to handle properly. Many campers without these skills still choose to light fires. Also, weather conditions can affect traditional campfires. In windy and wet conditions a campfire is difficult to light and in extremely dry seasons open fires may be prohibited. In campgrounds the number of users wishing to light a campfire results in a high demand for a diminishing fuel source and the production of a large amount of smoke which can cause discomfort to those suffering from allergies.

In the prior art applicant is aware of U.S. Pat. No. 5,868,128 which issued Feb. 9, 1999 to Omar for a Firepit. Omar discloses supplying gas, through spaced outlet ports in a gas line, upwardly into a suspended bed of lava rocks. What is neither taught nor suggested, and which it is an object of the present invention to provide, is the use of small particulate filler which presents much more the impression of a smooth surface through which gas jets are radially inwardly inclined so as to simulate, once lit, a conically-shaped campfire.

It is a further object of this invention to provide a portable, re-usable, non-woodburning campfire which is easy to light, safe to use, smoke free and which provides the appearance, warmth and enjoyment of the traditional wood burning campfire.

SUMMARY OF THE INVENTION

The portable gas campfire of the present invention includes an integral stand and base and may include a removable lid all of which may, in one embodiment, be fabricated from 22ga. galvanized steel. The lid may have a carrying handle mounted to it. Catches secure the lid to the base. In one embodiment, the base and lid are generally circular in horizontal planar section. However, they may be made in other shapes.

Secured to the bottom wall of the base by means of a spacer bracket is an annular burner ring tube. The burner ring contains a plurality of radially spaced apart burner orifices. These orifices are positioned on the burner tube so as to face radially inwardly and upwardly. That is, the bore axes of the orifices form the shape of a cone above the burner. Thus because the gas or fuel jets from the orifices follow generally along the bore axes, the orientation of the burner orifices result in flames being directed in a generally inwardly and upwardly direction. The resulting fire has a generally conical appearance.

The burner tube is secured to the spacer bracket by welding or the like. The spacer bracket is bolted to the bottom wall of the base. The base is advantageously filled with fine, garden grade vermiculite or other appropriately granular and non-flammable fill, to a level slightly above the upper surface of the burner tube, that is, so as to cover the burner tube. Ceramic logs may be positioned over the burner tube, on the surface of the fill.

The portable campfire is connected to a source of fuel such as a propane tank or natural gas line through a regulator assembly. A series of fittings between the burner tube, the base and the regulator assembly regulate the fuel/air mixture to the burner. Fittings connect the gas supply to the burner vertically upwards through the bottom wall of the base.

The burner tube may have a tee or like fitting to permit the inlet venturi tube to pass vertically downwardly from the burner tube through the bottom wall of the base and laterally outwardly through the stand. The end of the venturi tube is connected to a fuel/air mixing fitting, which allows air to be mixed with the fuel.

A shut-off valve to which the base and regulator are connected has a fuel regulating orifice threaded into the fuel outlet side of the valve.

In summary, the gas-fired portable campfire of the present invention comprises: (a) a base container, (b) a gas burner tube mounted into the base container, and (c) non-flammable low-density particulate insulating filler such as vermiculite or the like mountable into the base container so as to cover the gas burner. The gas burner tube has an inlet aperture for mounting to a gas supply and a spaced apart array of outlet apertures arranged so as to be radially spaced generally around a center of the container. The outlet apertures are radially inwardly inclined so as to direct gas jets from the outlet apertures upwardly and inwardly toward the center so as to form a generally conically shaped flame pattern when the gas jets are ignited.

Advantageously artificial non-flammable logs are mountable into the container and onto the filler when the filler is mounted into the container so as to cover the gas burner tube. The logs are positionable so as to lie in the conically shaped flame pattern.

In one aspect of the invention, the gas burner tube includes an annular tube and a gas supply line. The supply line is mounted to the annular tube in fluid communication therewith. The inlet aperture may be a restriction orifice in the gas supply line.

DETAILED DESCRIPTION OF PREFERRED EMBODIMENTS

Figure 1:
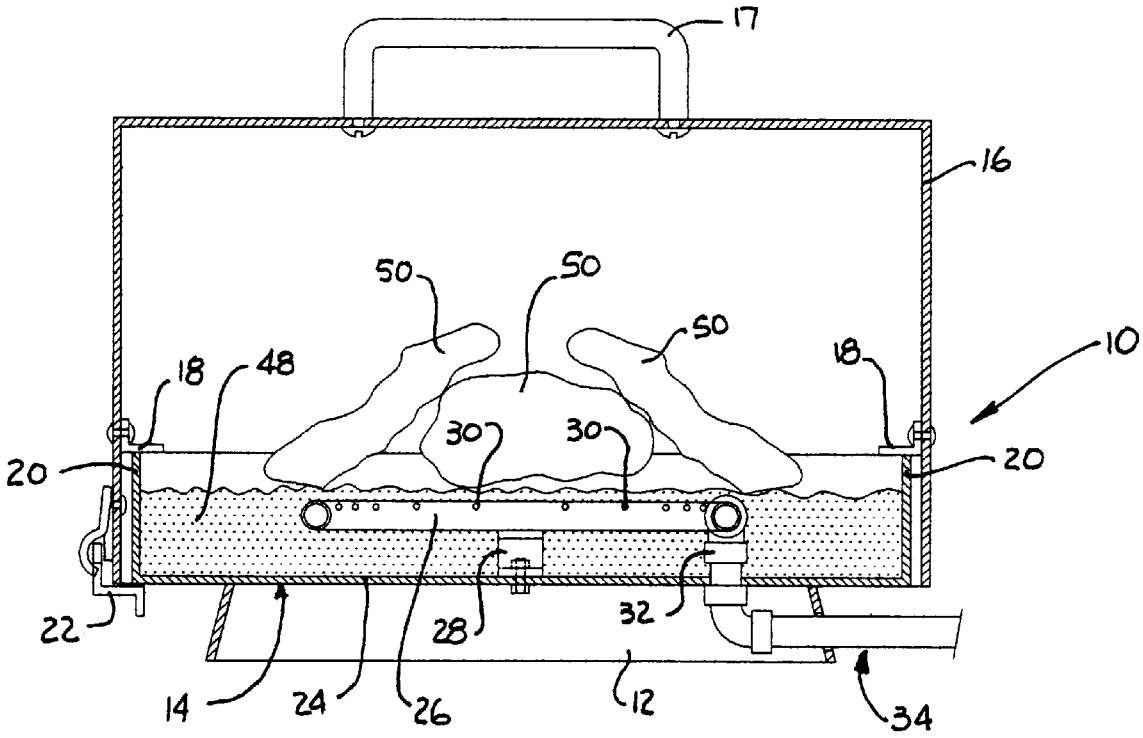
FIG. 1 is a sectional view through the portable log campfire of the present invention with the cover in place.
Figure 2:
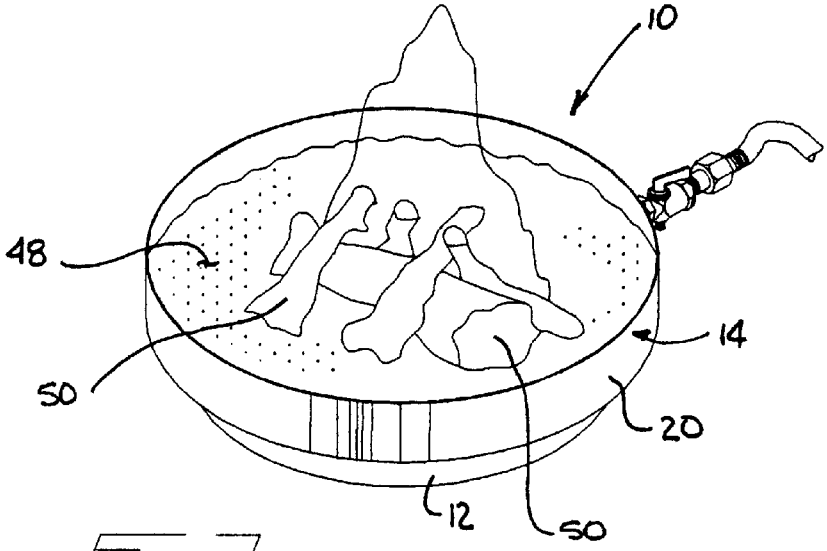
FIG. 2 is an isometric view of the portable log campfire in use.

As illustrated in the accompanying figures, where in similar numerical reference numbers indicate corresponding parts in each of the several views, portable gas campfire 10 has a stand 12 and a base 14. The stand and base of campfire 10 may be secured together as by welding. A cover or lid 16, having a carrying handle 17, can be positioned over base 14. The downward movement of lid 16 relative to base 14 is limited by internal brackets 18. Brackets 18 contact the vertical annular wall 20 of base 14 to limit downward travel of lid 16 over base 14. Spring clips 22 secured to the outside of the lid portion 16 when, in the closed position as shown in FIG. 1, engage the underside of bottom wall 24 of base 14, to hold the lid and base securely together.

Securely mounted within base 14 is a circular shaped burner tube 26 which is spaced above the bottom wall 24 of base 14 on a spacer bracket 28. Bracket 28 can be secured to burner tube 26 as by welding and spacer bracket 28 is secured to the bottom wall of base 14 as by bolting.

Figure 3:
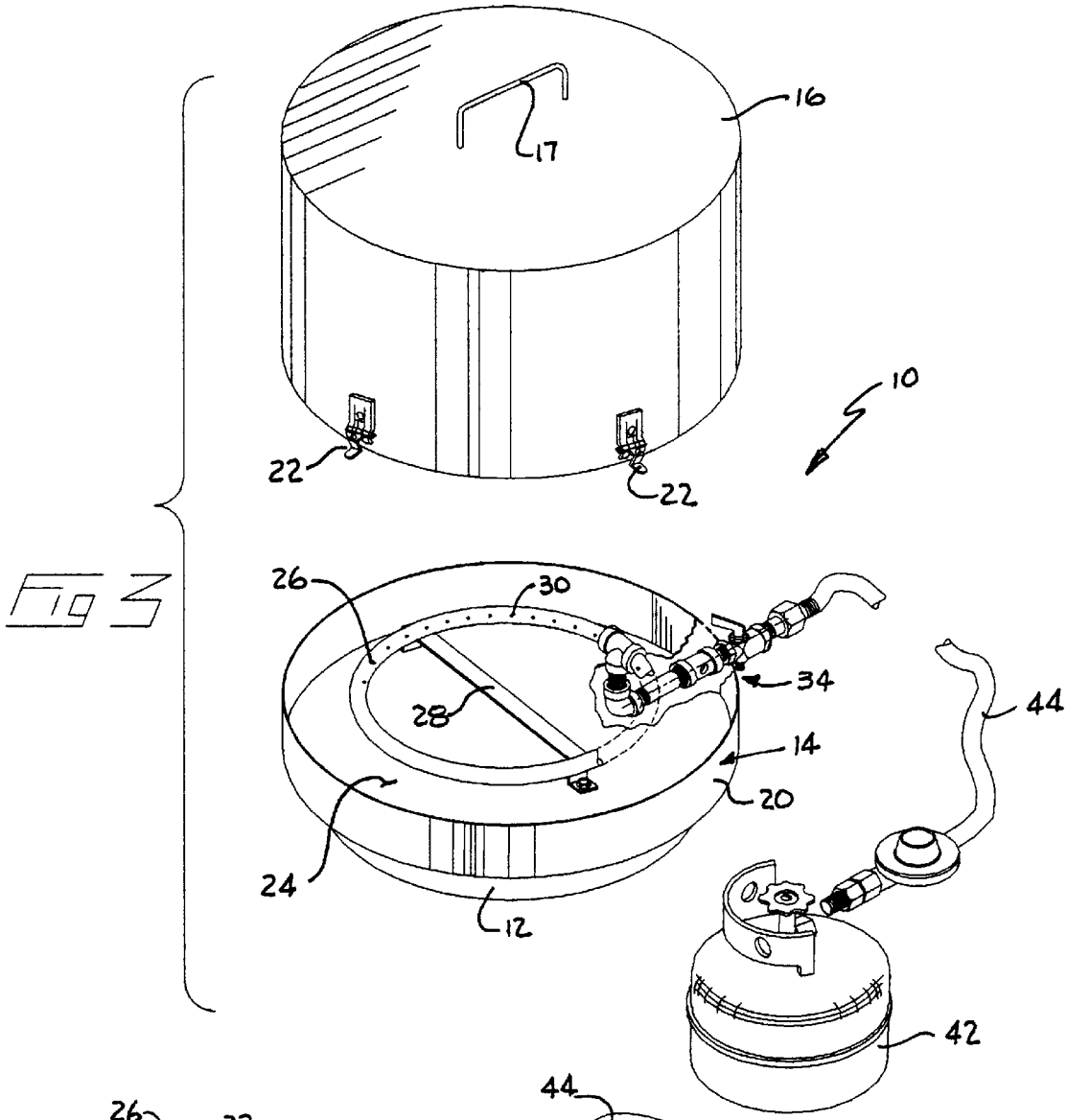
FIG. 3 is an exploded isometric view of the components of the campfire of the present invention.
Figure 4:
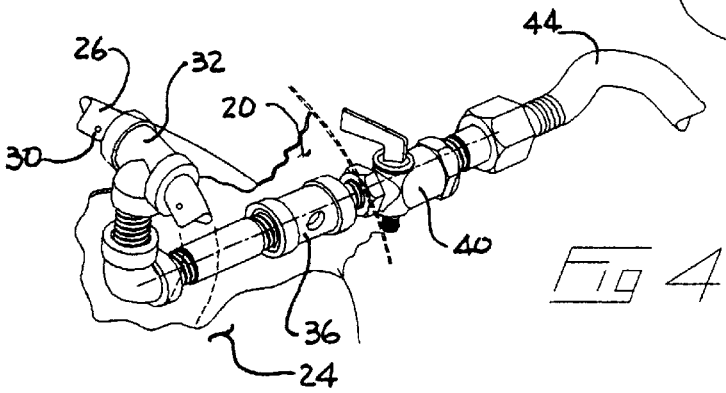
FIG. 4 is an enlarged view of the fuel inlet components of FIG. 3.
Figure 5:
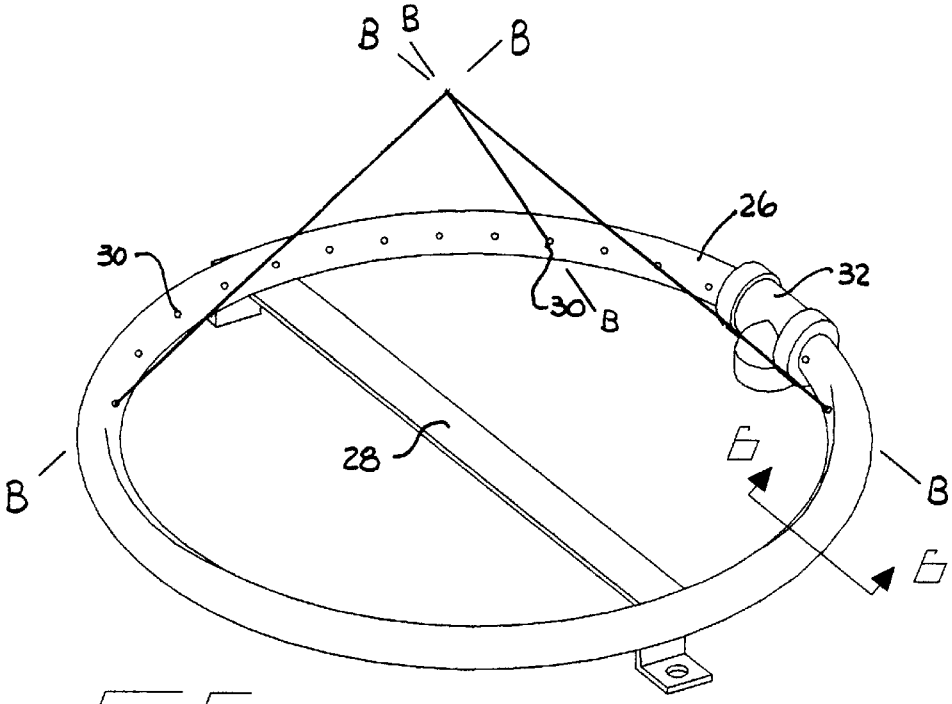
FIG. 5 is an enlarged isometric view of the burner tube of FIG. 3.
Figure 6:
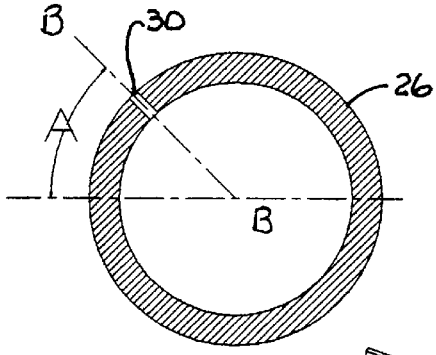
FIG. 6 is an enlarged section along line 6—6 of FIG. 5.
Figure 7:
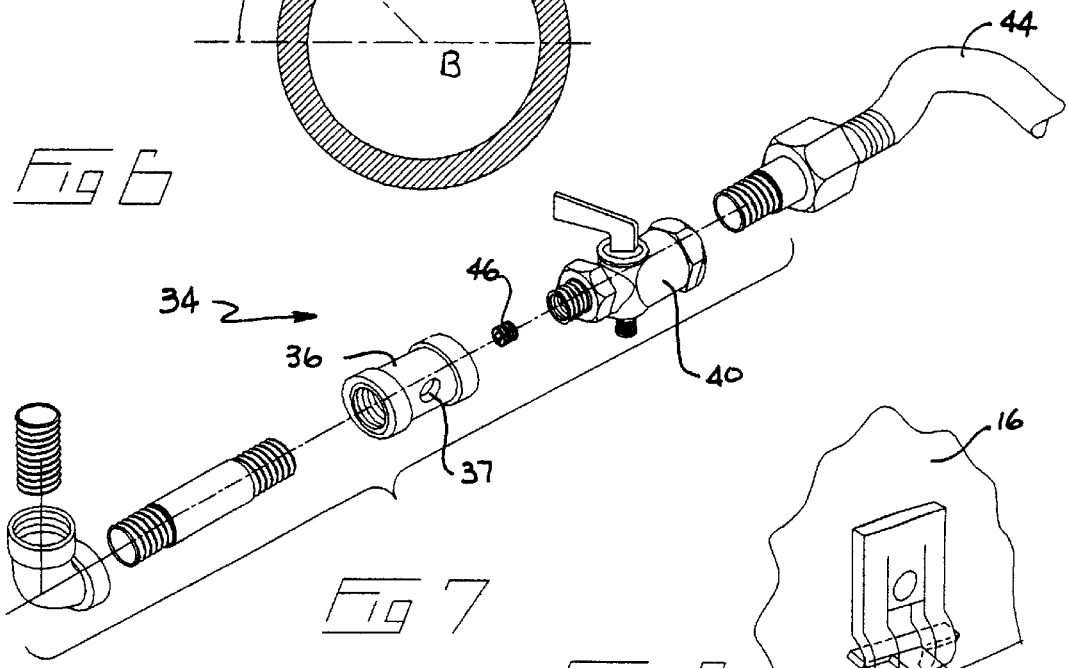
FIG. 7 is an enlarged exploded isometric view of the fuel inlet components of FIG. 4.
Figure 8:
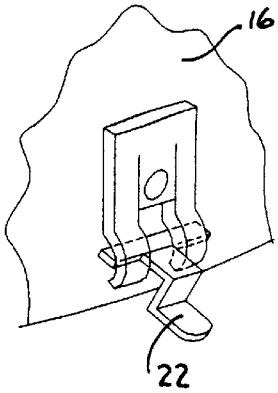
FIG. 8 is an isometric view of the lid catch.

Burner tube 26 has a plurality of radially spaced orifices 30 about its interior perimeter. As can be seen in FIG. 6, each orifice is inwardly and upwardly oriented along axes B—B from a horizontal plane approximately 45 degrees as indicated by angle A seen in FIG. 6. A tee 32 or other similar fitting may be incorporated in burner tube 26 to permit the connection of a fuel venturi tube 34. As may be seen in FIGS. 1 and 3, venturi tube 34 passes vertically upwardly through bottom wall 24 of base 14 and laterally outwardly through stand 12. The fuel venturi tube 34 has a fuel/air mixing fitting 36, having a plurality of orifices 37 and a shut-off valve 40. Fuel for campfire 10 may thus be supplied from, for example, a portable gas cylinder 42 through a flexible hose and pressure regulator assembly 44. Fuel is delivered from cylinder 42 to valve 40 under pressure. A restriction orifice 46 is provided at the outlet side of shut-off valve 40, which regulates the flow of fuel through air mixing fitting 36 and into burner 26.

Base 14 is filled with garden grade vermiculite or other appropriate non-flammable fill 48 sufficient to completely cover annular burner tube 26. Conventional ceramic logs 50 may then placed within base 14, over burner tube 26 to replicate a natural wood burning campfire. Once the fuel is ignited, the flames initially lie along axes B—B. They are however diffused by both the fill 48 and logs 50 along their generally inwardly and upwardly conical path from burner orifices 30 to give the general appearance of the traditional campfire.

Elevating base portion 14 above the ground on stand portion 14 coupled with filling base 14 with fill 48 reduces radiant heat toward the ground surface.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A gas-fired portable campfire comprising:

(a) a base container, (b) a gas burner tube mounted into said base container, (c) non-flammable granular insulating filler mountable into said base container so as to cover said gas burner tube, said gas burner tube having an inlet aperture for mounting of a gas supply thereto and a spaced apart array of outlet apertures arranged on said gas burner tube so as to be radially spaced generally around a center of said container, said array of outlet apertures radially inwardly inclined so as to direct gas jets from said array of outlet apertures upwardly and inwardly toward said center so as to form a generally conically shaped flame pattern when said gas jets are ignited, said conically shaped flame pattern having its vertex above an upper surface of said granular insulating filler when said insulating filler is mounted in said base container.

2. The gas-fired portable campfire of claim 1 further comprising artificial non-flammable logs mountable into said container and onto said filler, when said filler is mounted into said container so as to cover said gas burner tube, positionable so as to lie in said conically shaped flame pattern.

3. The gas-fired portable campfire of claim 1 wherein said filler is low density filler.

4. The gas-fired portable campfire of claim 3 wherein said filler is vermiculite.

5. The gas-fired portable campfire of claim 1 wherein said gas burner tube comprises an annular tube and a gas supply line mounted to said annular tube in fluid communication therewith, and wherein said inlet aperture is a restriction orifice in said gas supply line.

* * * * *